United States Patent [19]

Miller

[11] Patent Number: 4,954,673

[45] Date of Patent: Sep. 4, 1990

[54] HIGHLY SENSITIVE SWITCH FOR ACTUATION OF A DEVICE UPON FORCE BEING APPLIED THERETO

[75] Inventor: Norman K. Miller, Concordville, Pa.

[73] Assignee: Miller Edge, Inc., Concordville, Pa.

[21] Appl. No.: 384,348

[22] Filed: Jul. 21, 1989

[51] Int. Cl.[5] ..... H01H 3/16

[52] U.S. Cl. ..... 200/61.43

[58] Field of Search ..... 200/61.43, 86 R

[56] References Cited

U.S. PATENT DOCUMENTS

| | | | |
|---|---|---|---|
| 2,773,148 | 12/1956 | Ruby | 200/86 R |
| 3,133,167 | 5/1964 | Miller | 200/61.43 |
| 3,243,540 | 3/1966 | Miller | 200/86 R |
| 3,315,050 | 4/1967 | Miller | 200/61.43 |
| 3,321,592 | 5/1967 | Miller | 200/61.43 |
| 3,462,885 | 8/1969 | Miller | 49/488 |
| 4,051,336 | 9/1977 | Miller | 200/61.43 |
| 4,137,116 | 1/1979 | Miller | 200/86 R X |
| 4,200,777 | 4/1980 | Miller | 200/85 A |
| 4,362,911 | 12/1982 | Scars et al. | 200/5 A |
| 4,401,896 | 8/1983 | Fowler et al. | 307/118 |
| 4,497,989 | 2/1985 | Miller | 200/86 R |

*Primary Examiner*—J. R. Scott

*Attorney, Agent, or Firm*—Panitch Schwarze Jacobs & Nadel

[57] ABSTRACT

A highly, sensitive switch for actuation of a device upon force being applied to the switch and method for making the same. The switch includes a first layer of non-conductive material, a first sheet of resiliently compressible material, a first sheet of flexible, electrically conductive material, a second layer of non-conductive material, a second sheet of flexible, electrically conductive material, a second sheet of resiliently compressible material and a third layer of non-conductive material arranged in the recited order. The first, second and third layers of non-conductive material are constructed of a polymeric material and have the same general thickness. The first and second layers of flexible, electrically conductive material include electrical conductors attached thereto for connection with a circuit for controlling the actuation of the device in response to the application of force to switch. The first and second sheets of flexible, electrically conductive material are spaced apart by the second layer of non-conductive material and presents opposed portions to each other through an opening in the second layer of non-conductive material whereby upon the application of force to the switch, a portion of the first sheet of flexible, electrically conductive material deflects into the opening in the second layer of non-conductive material and into contact with a portion of the second sheet of flexible, electrically conductive material to thereby actuate the device.

14 Claims, 1 Drawing Sheet

FIG. 1
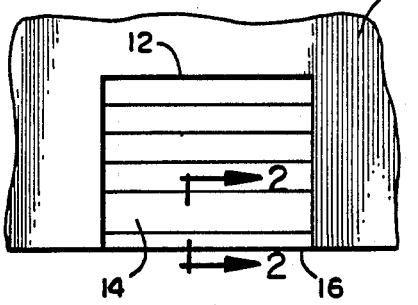
FIG. 2
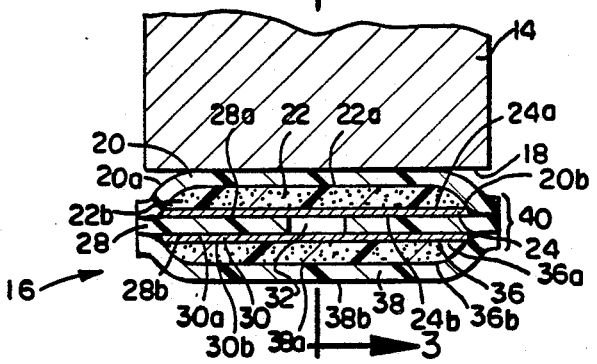
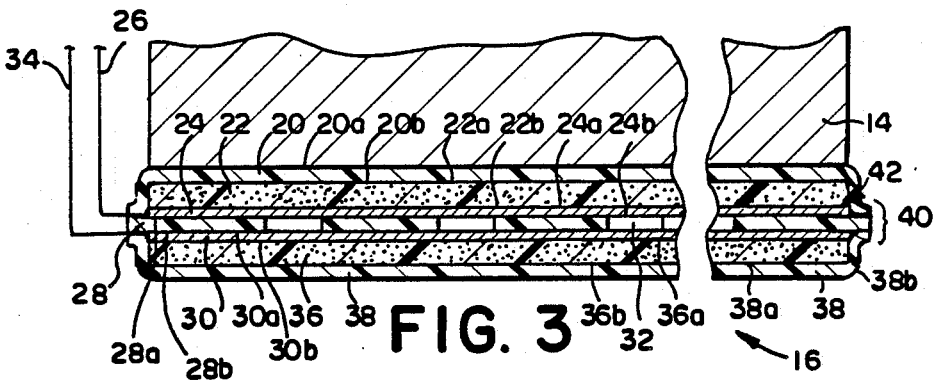
FIG. 3

HIGHLY SENSITIVE SWITCH FOR ACTUATION OF A DEVICE UPON FORCE BEING APPLIED THERETO

FIELD OF THE INVENTION

The present invention relates to a highly sensitive switch and, more particularly, to a highly sensitive switch for actuation of a device upon force being applied to the switch and method of making the same.

BACKGROUND OF THE INVENTION

It is known to fabricate safety-edge constructions for doors, alarm switches and the like of relatively soft, resiliently yieldable material, such as plastic foam. The material is capable of being structurally formed in cooperative relation with desired actuating means to obtain a high degree of sensitivity and reliability.

Generally, in switches of this type, there is required a highly localized deflection to operate the switch. Even a substantial force or weight may not be sufficient to actuate such a switch, if the force or weight was distributed over a substantial area. In an attempt to obviate this problem, such switches often include internal protrusions for locally enhancing internal forces reacting to an external weight. This structure added to cost of the materials, complexity of manufacture, and often inhibited or reduced flexibility and, therefore, requires additional space for shipping and storage.

Consequently, a need has arisen for a highly sensitive switch which actuates a device upon a very slight force being applied thereto. There further exists a need for such a highly sensitive switch which can be easily and readily manufactured without incurring prohibitive manufacturing costs.

The present invention is directed to a highly sensitive switch which actuates a device upon a small force being applied thereto. The switch of the present invention is relatively compact and can include adhesive on one side so that it may be retrofitted to any existing structure and the other side can include instructions or decorative markings. In addition, the present invention overcomes the problems inherent in the manufacturing of the prior art switches by placing the layers of the switch together in a specified arrangement and merely welding the lateral edges and trimming the excess off of the edges to thereby form a switch. Consequently, the manufacturing process of the present invention results in considerable savings of money and time for manufacture.

SUMMARY OF THE INVENTION

Briefly stated, the present invention comprises a highly sensitive switch for actuation of a device upon force being applied to the switch. The switch comprises a first layer of non-conductive material for attachment to a surface. The first layer of material has a first face and second face. The switch further includes a first sheet of resiliently compressible material having a first face and a second face. The first face of the first sheet of resiliently compressible material is in engagement with the second face of the first layer of material. The first sheet of resiliently compressible material is in engagement with a first sheet of flexible, electrically conductive material having a first face and a second face. The first face of the first sheet of flexible, electrically conductive material is in engagement with the second face of the first sheet of resiliently compressible material. In engagement with the first sheet of flexible, electrically conductive material is a second layer of non-conductive material having a first face and a second face. Specifically, the first face of the second layer of material is in engagement with the second face of the first sheet of flexible, electrically conductive material. The second layer of non-conductive material includes at least one opening extending therethrough between the first and second faces thereof. The second layer of non-conductive material is in engagement with a second sheet of flexible, electrically conductive material having a first face and a second face. The first face of the second sheet of flexible, electrically conductive material is in engagement with the second face of the second layer of non-conductive material. The second sheet of flexible, electrically conductive material is in engagement with a second sheet of resiliently compressible material having a first face and a second face. The first face of the second sheet of resiliently compressible material is in engagement with the second face of the second sheet of flexible, electrically conductive material. The switch further includes a third layer of non-conductive material having a first face and a second face. The first face of the third layer of non-conductive material is in engagement with the second face of the second sheet of resiliently compressible material. The first and second sheets of flexible, electrically conductive material are spaced apart by the second layer of non-conductive material and present opposed portions to each other through the opening whereby upon the application of force to the switch, a portion of the first sheet of flexible, electrically material deflects into the opening in the second layer of non-conductive material and into contact with a portion of the second sheet of flexible, electrically conductive material to thereby actuate the device.

BRIEF DESCRIPTION OF THE DRAWINGS

The foregoing summary, as well as the following detail description of the preferred embodiment, is better understood when read in conjunction with the appended drawing. For the purpose of illustrating the invention, there is shown in the drawing an embodiment which is presently preferred, it being understood, however, that the invention is not limited to the specific methods and instrumentalities disclosed. In the drawing:

FIG. 1 is front elevational view showing a door construction including a highly sensitive switch in accordance with the present invention;

FIG. 2 is a greatly enlarged crosssectional view of a portion of the door and the highly sensitive switch taken along line 2—2 of FIG. 1;

FIG. 3 is a cross-sectional view of a portion of the door and the highly sensitive switch taken along line 3—3 of FIG. 2.

DETAILED DESCRIPTION OF PREFERRED EMBODIMENT

Certain terminology is used in the following description for convenience only, and is not limiting. The words, "right," "left," "lower" and "upper" designate directions in the drawings to which reference is made. The words "inwardly" and "outwardly" refer to directions toward and away from, respectively, the geometric center of the highly sensitive switch and designated parts thereof. The terminology includes the words above specifically mentioned, derivatives thereof and words of similar import.

Referring to the drawing in detail, wherein like numerals indicate like elements throughout, there is shown in FIGS. 1 through 3 a preferred embodiment of a highly sensitive switch in accordance with the present invention. There is shown in FIG. 1 a building wall 10 having a doorway 12 provided with a door 14. While the door 14, as illustrated, is an overhead door, having a highly sensitive switch 16 in accordance with the present invention along its lower side or leading edge 18, it is within the spirit and scope of the invention to incorporate the safety edge described hereinafter, along the edge of any door structure, such as vertically disposed or horizontally movable doors as desired. Moreover, it is understood by those skilled in the art that the highly sensitive switch 16 is not limited to use in connection with doors, but can be used for other applications, such as mat switches or finger actuated key pads.

Referring now to FIG. 2, switch 16 extends substantially along the lower or leading edge 18 of the door 14, to protect persons, equipment and the door 14 from impact or other damage, as is understood by those skilled in the art. The switch 16 is secured to the leading door edge 18 by an adhesive (not shown) applied between the leading edge 18 and the peripheral face of the switch 16. In the present embodiment, it is preferred that the switch 16 be secured to the leading edge 18 with an epoxy, but it is within the ambit of the skilled artisan to use other adhesive materials for securing the switch 16 to the leading edge 18, such as double-sided tape or some other type of brush on or spray on adhesive.

Referring now to FIGS. 2 and 3, there is shown a first layer of non-conductive material 20 for attachment of the switch 16 to the leading edge 18 of the door 14 or to a desired surface when the switch 16 is used in other applications. The first layer of material 20 has a first face **20*a* and a second face 20*b*. Further, the first layer of material 20 has a predetermined, substantially uniform thickness of about 0.5 mm to 2 mm. In the present embodiment, it is preferred that the first layer of non-conductive material 20** be constructed of a translucent or clear polymeric material, such as polyvinyl chloride, polyethylene, polypropylene, or any other such material.

In the present embodiment, it is preferred that the first layer of non-conductive material 20 and succeeding layers, described hereinafter, be generally sized to complement the leading edge 18 of the door 14. However, it is understood by those skilled in the art that the first layer 20 and succeeding layers can be sized as wide or as narrow as desired, and be of virtually any length for accommodating different structures and uses.

The first layer of non-conductive material 20 is in engagement with a first sheet of resiliently compressible material 22 also preferably non-conductive and having a first face **22*a* and a second face 22*b* for providing the switch 16 with resilient qualities, to thereby increase its useful life. Specifically, the first face 22*a* of the first sheet of resiliently compressible material 22 is in engagement with the second face 20*b* of the first layer of material 20 such that the first face 22*a* and the second face 20*b* are in corresponding facing relationship. In the present embodiment, it is preferred that the first sheet of resiliently compressible material 22 be constructed of generally soft foam rubber. It is understood by those skilled in the art that the first sheet of resiliently compressible material 22** can be constructed of either closed or open cell foam rubber or of other materials having similar properties.

Just below, (when viewing FIGS. 2 and 3) the first sheet of resiliently compressible material 22 is a first sheet of flexible, electrically conductive material 24, engaged therewith, and having a first face **24*a* and a second face 24*b*. The first face 24*a* of the first sheet of flexible, electrically conductive material 24 is in engagement or in corresponding facing relationship with the second face 22*b* of the first sheet of resiliently compressible material 22. In the present embodiment, it is preferred that the first sheet of flexible, electrically conductive material 24** be generally thin and preferably be constructed of aluminum or aluminum foil. However, it is within the spirit and scope of the invention to construct the first sheet of flexible, electrically conductive material of other such materials, such as copper or brass or alloy thereof.

As shown in FIG. 3, an electrical conductor or wire 26 is electrically connected to the first sheet of flexible, electrically conductive material 24 preferably by soldering at one end thereof. The electrical conductor is used in connection with a circuit for controlling the actuation of the device or door 14, as is understood by those skilled in the art, in response to the application of force to the switch, as described hereinafter.

The first sheet of flexible, electrically conductive material 24 is in engagement with a second layer of non-conductive material 28 having a first face **28*a* and a second face 28*b* for spacing apart the first sheet of flexible, electrically conductive material 24 and a second sheet of flexible, electrically conductive material 30. The second layer of non-conductive material 28 has substantially the same thickness and shape as the first layer of non-conductive material 20 and includes at least one opening 32 extending therethrough between the first and second faces 28*a* and 28*b* thereof. As shown in FIG. 3, the second layer of non-conductive material preferably includes a plurality of openings 32 interspersed therealong for allowing the actuation of the switch 16 by applying pressure thereto, as described hereinafter. The first face 28*a* of the second layer of non-conductive material 28 is in engagement or corresponding facing relationship with the second face 24*b* of the first sheet of flexible, electrically conductive material 24**.

In the present embodiment, it is preferred that the openings 32 be generally oval shaped. However, it is within the spirit and scope of the invention to configure the opening 32 of an geometric shape, such as square or circular.

The second layer of the non-conductive material 28 is preferably constructed of the same material as the first layer of non-conductive material 20. However, it is understood by those skilled in the art, that the first and second layers of non-conductive material 20 and 28 can be constructed of different materials.

The second layer of non-conductive material 28 is in engagement with a second sheet of flexible, electrically conductive material 30 having a first face **30*a* and second face 30*b*. The first face 30*a* of the second sheet of flexible, electrically conductive material 30 is in engagement or corresponding facing relationship with the second face 28*b* of the second layer of non-conductive material 28**.

In the present embodiment, it is preferred that the second sheet of flexible, electrically conductive material 30 be constructed of the same material and configuration as the first sheet of flexible, electrically conductive material 24. Similarly, the second sheet of flexible, electrically conductive material 30 includes an electrical conductor or wire 34 electrically connected to one end thereof for connection with a circuit for controlling the actuation of the door or device in response to the application of force to the switch 16 (described hereinafter).

In engagement with the second sheet of flexible, electrically conductive material 30 is a second sheet of resiliently compressible material 36 having a first face 36*a* and a second face 36*b*. The first face 36*a* of the second sheet of resiliently compressible material 36 is in engagement or corresponding facing relationship with the second face 30*b* of the second sheet of the flexible, electrically conductive material 30. The second sheet of resiliently compressible material 36 is preferably constructed of the same material and configured generally identically to the first sheet of resiliently compressible material 22. However, it is apparent to those skilled in the art that the first and second sheets of resiliently compressible material 22 and 36 can differ in size and material.

The second sheet of resiliently compressible material 36 is in engagement with a third layer of non-conductive material 38 having a first face 38*a* and a second face 38*b*. The first face 38*a* of the third layer of non-conductive material 38 is in engagement or corresponding facing relationship with the second face 36*b* of the second sheet of resiliently compressible material 36. In the present embodiment, it is preferred that the third layer of non-conductive material 38 be constructed of the same material and have the same thickness as the first and second layers of non-conductive material 20 and 28.

As shown in FIG. 3, the first and second sheets of flexible, electrically conductive material 24 and 30 are spaced apart by the second layer of non-conductive material 28 and present opposed, separated portions to each other through the openings 32 whereby upon the application of force to the switch 16, a portion of the first sheet of flexible, electrically conductive material 24 deflects (not shown) into one or more of the openings 32 in the second layer of non-conductive material 28 and into contact with an opposed portion of the second sheet of flexible, electrically conductive material 30 to thereby complete an electrical circuit to actuate the device or door through suitable circuitry in a manner well understood by those skilled in the art.

The highly sensitive switch 16 can be actuated by the application of force in any direction anywhere along the first and third layers of non-conductive material 20 and 38. More particularly, due to the construction of the switch 16, as described above, the first and second sheets of flexible, electrically conductive material 24 and 30 may be engaged through the openings 32 by either applying a compressive force to the switch 16 or by pushing or pulling laterally inwardly or outwardly along the periphal edges of the switch. Consequently, by constructing the switch 16 in the above described manner, a highly sensitive switch is yielded which makes electrical contact upon the application of very slight force thereto. It is understood by those skilled in the art that one of the sheets of electrically conductive material can be of static construction so that the switch 16 can only be actuated by the application of pressure to only one side thereof.

It is understood by those skilled in the art that the number and shape of the openings 32 in the second layer of non-conductive material are selected so that the switch 16 is highly sensitive to the application of very slight forces. Consequently, the present invention is not limited to the number or size of the openings 32, described herein.

As shown in FIGS. 2 and 3, the first, second and third layers of non-conductive material 20, 28 and 38, the first and second sheets of resiliently compressible material 22 and 36, and the first and second sheets of flexible, electrically conductive material 24 and 30 each have a circumferential edge. The circumferential edge of the first, second and third layers of non-conductive material, generally designated 40, extends just beyond the circumferential edge of the first and second sheets of resiliently, compressible material 22 and 36, and the first and second sheets of flexible, electrically material 24 and 30, generally designated 42.

As shown in FIGS. 2 and 3, the first, second and third layers of non-conductive material 20, 28 and 38 have their circumferential edges 42 welded together such that the first and third layers of non-conductive material 20 and 38 form a casing wherein the first and second sheets of resiliently compressive material 22 and 36 and the first and second sheets of flexible, electrically conductive material 24 and 30 are encased therein. By welding the edges 40 of the first, second and third layers of non-conductive material 20, 28 and 38, the first and second sheets of flexible, electrically conductive material 24 and 30 are maintained a predetermined distance apart which adds to the sensitivity of the switch 16 due to its uniform construction.

In the present embodiment, it is preferred that the edges 40 of the first, second and third layers of non-conductive material 20, 28 and 30 be electronically welded together. However, it is understood by those skilled in the art that other welding methods can be used, depending upon the material used, such as radiant heat welding or other like process.

The method of making the highly sensitive switch 16, comprises the steps of placing the first, second and third layers of non-conductive material 20, 28 and 38, the first and second layers of flexible, electrically conductive material 24 and 30 and the first and second layers of resiliently compressible material 22 and 36 in the arrangement described above.

The first, second and third layers of non-conductive material 20, 28 and 30 are arranged such that their circumferential edges 40 extend beyond the circumferential edges 42 of the sheets of material 22, 24, 30 and 36. The circumferential edges 42 of the first, second and third layers of non-conductive material 20, 28 and 38 are secured together by welding or other similar process whereby the first and third layers of nonconductive material 20 and 38 form a casing such that the first and second sheets of resiliently compressible material 2 and 36 and first and second sheets of flexible, electrically conductive material 24 and 30 are encased therein. Once the circumferential edges 42 have been welded, any excess material is trimmed off to provide the switch 16 with a neat and clean appearance.

It is understood by those skilled in the art that the layers and sheets can be oversized compared to a desired dimension of the switch such that a plurality of switches could be simultaneously welded and trimmed in a similar manner to reduce manufacturing costs.

From the foregoing description, it can be seen that the present invention comprises a highly sensitive switch for actuation of a device upon force being applied to the switch and method of making the same. It will be appreciated by those skilled in the art that changes could be made to the embodiment described above without departing from the broad inventive concept thereof. It is understood, therefore, that this invention is not limited to the particular embodiment disclosed, but it is intended to cover all modifications which are within the scope and spirit of the invention as defined by the appended claims.

I claim:

1. A highly sensitive switch for actuating of a device upon force being applied to said switch, said switch comprising:

a first layer of non-conducting material for attachment to a surface, said first layer of material having a first face and a second face;

a first sheet of resiliently compressible material having a first face and a second face, said first face of said first sheet of resiliently compressible material being in engagement with said second face of said first layer of material;

a first sheet of flexible, electrically conductive material having a first face and a second face, said first face of said first sheet of flexible, electrically conductive material being in engagement with said second face of said first sheet of resiliently compressible material;

a second layer of non-conductive material having a first face and a second face, said first face of said second layer of material being in engagement with said second face of said first sheet of flexible, electrically conductive material, said second layer of non-conductive material including at least one opening extending therethrough between said first and second faces thereof, said first and second layers of non-conducting material being constructed of the same material;

a second sheet of flexible, electrically conductive material having a first face and a second face, said first face of said second sheet of flexible, electrically conductive material being in engagement with said second face of said second layer of non-conductive material;

a second layer of resiliently compressible material having a first face and a second face, said first face of said second sheet of resiliently compressible material being in engagement with said second face of said second sheet of flexible, electrically conductive material;

a third layer of non-conductive material having a first face and a second face, said first face of said third layer of non-conducting material being in engagement with the second face of said second sheet of resiliently compressible material, said third layer of non-conducting material being constructed of the same material as said first and second layers of non-conducting material, said first and second sheets of flexible, electrically conductive material being spaced apart by said second layer of non-conductive material and present opposed portions to each other through said opening whereby upon the application of force to said switch, a portion of said first sheet of flexible electrically conductive material deflects into the opening in said second layer of non-conducting material and into contact with a portion of said second sheet of flexible, electrically conductive material to thereby actuate the device.

2. The highly sensitive switch as recited in claim 1 wherein said first, second and third layers of non-conductive material have a substantially identical thickness.

3. The highly sensitive switch as recited in claim 2 wherein said thickness of each of the first, second and third layers of non-conductive material is about 0.5 mm to 2 mm.

4. The highly sensitive switch as recited in claim 1 wherein said first, second and third layers of non-conductive material are a polymeric material.

5. The highly sensitive switch as recited in claim 4 further including electrical conductors connected to each of said first and second sheets of flexible, electrically conductive material for connection with a circuit for controlling the actuation of said device in response to the application of force to said switch.

6. The highly sensitive switch as recited in claim 5 wherein said first, second and third layers of polymeric material, said first and second sheets of resiliently compressible material, and said first and second sheets of flexible, electrically conductive material each have a circumferential edge, said circumferential edge of said first, second and third layers of polymeric material extending beyond said circumferential edge of said first and second sheets of resiliently compressible material and said first and second sheets of flexible, electrically conductive material, said first, second and third layers of polymeric material having their circumferential edges welded together such that said first and third layers of polymeric material form a casing, and said first and second sheets of resiliently compressible material and said first and second sheets of flexible, electrically conductive material are encased therein.

7. The highly sensitive switch as recited in claim 1 wherein said first and second sheets of flexible, electrically conductive material are aluminum.

8. The highly sensitive switch as recited in claim 1 wherein said first and second sheets of resiliently compressible material are foam rubber.

9. A highly sensitive switch for the edge of a door to protect persons, equipment, and the door from impact damage, comprising:

a first layer of non-conductive material for attachment to a door, said first layer of material having a first face and a second face, said first layer of material having a predetermined substantially uniform thickness;

a first sheet of resiliently compressible foam rubber having a first face and a second face, said first face of said first sheet of foam rubber being in engagement with said first face of said first layer of material;

a first sheet of flexible, electrically conductive material having a first face and a second face, said first face of said first sheet of flexible, electrically conductive material being in engagement with said second face of said first sheet of foam rubber;

a second layer of non-conductive material having a first face and a second face for spacing apart said first sheet of flexible, electrically conductive material and a second sheet of flexible, electrically conductive material, said second layer of non-conductive material having substantially the same thickness as said first layer of non-conductive material and including at least one opening extending therethrough between said first and second faces thereof, said first face of said second layer of non-conductive material being in engagement with said second face of said first sheet of flexible, electrically conductive material;

a second sheet of flexible, electrically conductive material having a first face and a second face, said first face of said second sheet of flexible, electrically conductive material being in engagement with said second face of said second layer of non-conductive material;

a second sheet of resiliently compressible foam rubber having a first face and a second face, said first face of said second sheet of foam rubber being in engagement with said second face of said second sheet of flexible, electrically conductive material;

a third layer of non-conductive material having a first face and a second face, said third layer of non-conductive material having the same thickness as said first layer of non-conductive material, said first face of said third layer of non-conductive material being in engagement with said second face of said second sheet of foam rubber, said first and second sheets of flexible, electrically conductive material being spaced apart by said second layer of non-conductive material and present opposed portions to each other through said opening, whereby upon the application of force to said switch, a portion of said first sheet of flexible electrically conductive material deflects into the opening in said second layer of non-conducting material and into contact with a portion of said second sheet of flexible, electrically conductive material to thereby actuate the device.

10. The highly sensitive switch as recited in claim 9 further including electrical conductors connected to each of said first and second sheets of flexible, electrically conductive material for connection with a circuit for controlling the actuation door in response to the application of force to said safety edge.

11. The highly sensitive switch as recited in claim 10 wherein said first, second and third layers of non-conductive material, said first and second sheets of rubber foam, and said first and second sheets of flexible, electrically conductive material each have a circumferential edge, said circumferential edge of said first, second and third layers of non-conductive material extending beyond said circumferential edge of said first and second sheets of rubber foam and said first and second sheets of flexible, electrically conductive material, said first, second and third layers of non-conductive material having their circumferential edges welded together such that said first and third layers of material form a casing, and said first and second sheets of flexible, electrically conductive material are encased therein.

12. The highly sensitive switch as recited in claim 9 wherein said first and second sheets of flexible, electrically conductive material are aluminum foil.

13. The highly sensitive switch as recited in claim 9 wherein said first, second and third layers of non-conductive material are a polymer.

14. The highly sensitive switch as recited in claim 9 wherein said thickness of each of the first, second and third layers of nonconductive material is about 0.5 mm to 2 mm.

* * * * *